US006331370B1

(12) United States Patent
Schank et al.

(10) Patent No.: US 6,331,370 B1
(45) Date of Patent: Dec. 18, 2001

(54) SQUEAK AND DELETION RESISTANT IMAGING MEMBER AND SYSTEM

(75) Inventors: Richard L. Schank; William W. Limburg; Dale S. Renfer, all of Monroe, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/483,762

(22) Filed: Jun. 7, 1995

(51) Int. Cl.[7] ..... G03G 5/047

(52) U.S. Cl. ..... 430/58.3; 430/58.8; 430/125; 430/133

(58) Field of Search ..... 430/59, 125, 58.8, 430/133, 58.3

(56) References Cited

U.S. PATENT DOCUMENTS

| | | | | |
|---|---|---|---|---|
| 3,820,989 | | 6/1974 | Rule et al. . | |
| 3,997,342 | | 12/1976 | Bailey . | |
| 4,025,341 | | 5/1977 | Rule . | |
| 4,050,935 | | 9/1977 | Limburg et al. . | |
| 4,053,311 | | 10/1977 | Limburg et al. . | |
| 4,078,925 | * | 3/1978 | Horgan | 430/59 |
| 4,081,274 | * | 3/1978 | Horgan | 430/59 |
| 4,123,270 | | 10/1978 | Heil et al. | 96/1.5 R |
| 4,297,425 | | 10/1981 | Pai et al. . | |
| 4,346,158 | * | 8/1982 | Pai et al. | 430/59 |
| 4,457,994 | | 7/1984 | Pai et al. . | |
| 4,504,564 | * | 3/1985 | Pai et al. | 430/59 |
| 4,760,003 | | 7/1988 | Matsumoto et al. | 430/58 |
| 4,825,249 | * | 4/1989 | Oki et al. | 430/125 |
| 5,066,796 | | 11/1991 | Law | 540/140 |
| 5,117,264 | * | 5/1992 | Frankel et al. | 430/125 |
| 5,391,447 | * | 2/1995 | Pai et al. | 430/59 |

OTHER PUBLICATIONS

Borsenberger, Paul M. & David S. Weiss. Organic Photoreceptors for Imaging Systems. New York: Marcel–Dekker, Inc. pp. 6–17, 181–195, 200–201, 1993.*

* cited by examiner

*Primary Examiner*—Christopher Rodee

(74) *Attorney, Agent, or Firm*—Oliff & Berridge, PLC

(57) ABSTRACT

An imaging member includes a charge generation layer and a contiguous charge transport layer containing a diamine and a compound within the scope of formula (II):

(II)

wherein each $R_1$ and $R_2$ is independently one of an alkyl having 1 to 8 carbon atoms, aryl, alkaryl and aralkyl, where the aryl is a phenyl group or a condensed ring group, and where the alkyl group of the alkaryl and aralkyl has 1 to 4 carbon atoms, $R_3$ and $R_4$ are independently hydrogen or $CH_3$, and $R_5$ is one of an alkyl having 1 to 8 carbon atoms, aryl, alkaryl and aralkyl as defined above, or a disubstituted aminophenyl group wherein each substituent is independently one of an alkyl having 1 to 8 carbon atoms, aryl, alkaryl and aralkyl as defined above. A electrophotographic system includes a cleaning blade and the above imaging member drum.

4 Claims, 1 Drawing Sheet

SQUEAK AND DELETION RESISTANT IMAGING MEMBER AND SYSTEM

BACKGROUND OF THE INVENTION

This invention relates in general to xerography and more specifically to an imaging member comprising a novel charge transport layer. The invention further relates to a novel electrophotographic system containing a cleaning blade, particularly a doctor blade.

In recent years, interest has been shown in electrophotographic drums for use in high speed office copying machines. Some of these drums are multilayered devices comprising a conductive substrate layer, a blocking interface layer, an optional adhesive layer, a charge generation layer and a charge transport layer. The charge transport layer comprises an organic charge transport molecule dissolved in a polymeric matrix material. This layer is substantially nonabsorbing in the spectral region of intended use, e.g., visible light, but is "active" in that it allows (1) injection of photogenerated holes from the charge generation layer and (2) efficient transport of these charges to the surface of the transport layer to discharge a surface charge thereon.

One class of charge transport molecules, N,N'-diphenyl-N, N'-bis(alkylphenyl)-[1,1'-biphenyl]- 4,4'-diamines, has been extensively studied in the forms of solutions or dispersions in polycarbonate polymers. The conductivity of this class of compounds in polycarbonate polymers has been found to increase under certain circumstances. When imaging members employing this class of compounds have a residual amount of a halogen-containing alkane solvent in the transport layer and they are subjected to ultraviolet radiation, a condition known as "cycle down" progressively develops as the device is cycled in the xerographic process. "Cycle down" refers to the progressive increase in conductivity of the transport layer such that in a relatively short period of time the charge acceptance of the device deteriorates.

Also, special precautions have to be taken with regard to the handling of the devices employing these compounds. They cannot be stored or left exposed to ambient room light for any length of time because fluorescent lamps employed in most buildings contain a UV component. This UV radiation causes devices left exposed to the room light to undergo gradual deterioration resulting in an increase in the conductivity of the transport layer. Chemical stabilization of the physical properties of polymers has been well pursued and additives are available that stabilize various polymers against ultraviolet induced discoloration or ultraviolet induced mechanical failures.

A photoreceptor is also subjected to a large number of chemical species produced by the charging devices typically used. A number of these species, especially the oxides of nitrogen, can react with hole transporting materials. This results in an electrically conductive surface. An electrostatic image residing on such a surface tends to spread, and in severe cases can totally desperse, producing a fuzzy to non-existant final image. By chemical stabilization, as used in the present invention, is meant the elimination or minimization of chemically induced conductive species on the surface of the photoreceptor.

To be useful as a stabilizer in a cyclic duplicating machine, the additive, in addition to preventing chemical degradation, has to meet another stringent requirement. The additive should not introduce traps, or conductive species of its own. Even a small number of traps results in the cumulative trapping phenomenon generally referred to as "cycle up."The trap could be an isolated electronic state of the additive or result from the additive changing the character of the dispersion of the host molecule in the binder matrix. The generation of conductive species on the photoreceptor surface would result in unacceptable image quality. This conductive species could be the oxidized state of the hole transporting moiety present in the photoreceptor transport layer.

It has been found that when some multi-layered drum imaging members are cleaned with flexible cleaning blades, the cleaning blade interacts with the drum imaging members in such a way as to cause a vibration in the drum. This vibration may be perceived as an irritating squeak. This squeak can be eliminated by plasticizing the charge transport layer. However, plasticization of the charge transport layer softens the layer and adversely affects its durability. In other words, the layer, subjected to the abrasive conditions generated by the interaction of the development materials and processes, tends to wear out too rapidly. Also, high loading of plasticizers may adversely affect the electrical mobility of the imaging member and interfere with other electrical and physical properties.

U.S. Pat. No. 4,297,425, to Pai et al., discloses an imaging member containing a hole transport layer comprising a polycarbonate resinous material having a residual amount of a halogen-containing organic solvent. Dispersed in the layer is a diamine as a charge transport compound and a diaryl or triaryl methane compound as a stabilizing compound to overcome effects of the residual halogen-containing solvent. The reference discloses a weight ratio of the stabilizing compound to the diamine compound of from 0.0005:1 to 0.1:1.

However, U.S. Pat. No. 4,297,425 does not disclose any relationship of the diaryl or triaryl methane compound to squeaking in a drum imaging member cleaned using a cleaning blade. The reference does not teach the use of diaryl or triaryl methane compounds in amounts greater than 0.1:1 relative to the diamine compound or selecting an electrophotographic system comprising a cleaning blade and a drum imaging member with a transport layer containing a diaryl or triaryl methane compound. It also does not teach an imaging member having a transport layer free from halogen containing solvents comprising a diaryl or triaryl methane compound.

SUMMARY OF THE INVENTION

The present invention provides an electrophotographic system comprising a cleaning blade, preferably a doctor blade, and an imaging member, particularly a drum, comprising a charge generation layer and a charge transport layer comprising a diamine compound of the class defined below and a diaryl or triaryl methane compound of the class defined below.

The present invention further provides an imaging member comprising a charge generation layer and a charge transport layer comprising a diamine compound of the class defined below and a diaryl or triaryl methane compound, wherein the weight ratio of the methane compound to the diamine compound is preferably greater than 0.1:1.

The present invention further provides an imaging member comprising a charge generation layer and a charge transport layer comprising a diamine compound of the class defined below and a diaryl or triaryl methane compound of the class defined below, wherein the transport layer is free of halogen containing organic solvent.

It has been found that the addition to the transport layer of the diaryl or triaryl methane compound significantly reduces or eliminates chemical reactions leading to the deleterious effect of image blurring due to lateral conductivity on the photoreceptor surface. Further, the addition to the transport layer of a diaryl or triaryl methane compound significantly reduces the squeak problem when a drum imaging member is cleaned using a cleaning blade. The use of this class of additives has no apparent deleterious effects on the physical or electrical properties of the charge transport layer.

DETAILED DESCRIPTION OF PREFERRED EMBODIMENTS

Figure 1:
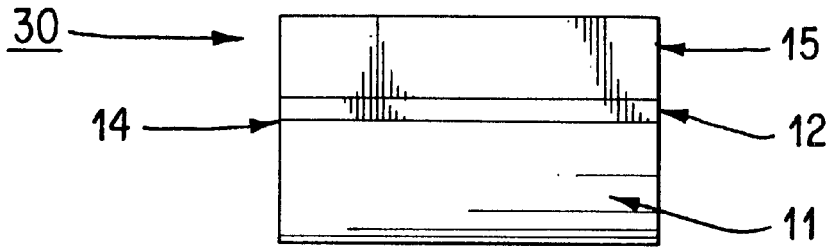
FIG. 1 is a schematic illustration of an embodiment of the instant invention, which comprises an imaging member having a charge generation layer overcoated with a charge transport layer.

Referring to FIG. 1, reference character 30 designates an imaging member that comprises a supporting substrate 11, a charge generation layer 12, and a charge transport layer 15.

Substrate 11 is preferably comprised of any conductive material. Typical conductors comprise aluminum, steel, nickel, brass or the like. The substrate may be rigid or flexible and of any convenient thickness. In a preferred embodiment, the substrate is a drum. In addition, other typical substrates include flexible belts or sleeves, sheets, webs, plates and cylinders. The substrate or support may also comprise a composite structure such as a thin conductive coating contained on a paper base; a plastic coated with a thin conductive layer such as aluminum, nickel or copper iodide; or glass coated with a thin conductive coating of chromium or tin oxide.

In a preferred embodiment, the imaging member further contains a blocking layer 14 between the substrate 11 and the charge generation layer 12. Charge blocking layer 14 may be any charge blocking layer known to one of ordinary skill in the art. In a more preferred embodiment, the charge blocking layer comprises an alcohol soluble polyamide.

In an embodiment, the imaging member further comprises an adhesive layer to adhere the charge generation layer 12 to the substrate.

Charge generation layer 12 generally contains photoconductive particles dispersed in binder.

Binder material may comprise any electrically insulating resin such as those disclosed in Middleton et al., U.S. Pat. No. 3,121,006, the entire disclosure of which is hereby incorporated by reference. Specific examples include, but are not limited to, polystyrene, acrylic and methacrylic ester polymers, polyvinyl carbazole, polyvinylchlorides, mixtures thereof and the like.

When using an electrically inactive or insulating resin, there should be particle-to-particle contact between the photoconductive particles. In this case, the photoconductive particles are preferably present in an amount of at least about 10% by volume of the binder layer, with no limit on the maximum amount of particles in the binder layer. If the matrix or binder comprises an active material, e.g., polyvinyl carbazole, the photoconductive particles need only comprise about 1% or less by volume of the binder layer with no limitation on the maximum amount of particles in the binder layer. The thickness of generation layer 12 is not critical and any suitable thickness may be selected so long as the objects of the invention are achieved. For example, layer thicknesses from about 0.05 to about 40 microns have been found to be satisfactory.

The photoconductive particles may be any material capable of photogenerating holes and injecting photogenerated holes into the contiguous charge transport layer 15. Any suitable inorganic or organic photoconductor, and mixtures thereof, may be employed. Inorganic materials include inorganic crystalline photoconductive compounds and inorganic photoconductive glasses. Typical inorganic compounds include, but are not limited to, cadmium sulfoselenide, cadmium selenide, cadmium sulfide, mixtures thereof and the like. Typical inorganic photoconductive glasses include, but are not limited to, amorphous selenium, selenium alloys such as selenium-tellurium, selenium-tellurium-arsenic, seleniumarsenic, mixtures thereof and the like. Selenium may also be used in a crystalline form known as trigonal selenium.

Typical organic photoconductive particles that may be used as charge generators in embodiments also include, but are not limited to, phthalocyanine pigment such as the X-form of metal free phthalocyanine described in U.S. Pat. No. 3,357,989 to Byrne et al; metal phthalocyanines such as copper or vanadyl phthalocyanine; quinacridones such as those available from duPont under the tradename Monastral Red, Monastral Violet and Monastral Red Y; substituted 2,4-diamino-triazines disclosed in U.S. Pat. No. 3,445,227 to Weinberger; triphenodioxazines disclosed in U.S. Pat. No. 3,442,781 to Weinberger; polynuclear aromatic quinones such as those available from Allied Chemical Corporation under the tradename Indo Double Scarlet, Indofast Violet Lake B, Indofast Brilliant Scarlet and Indofast Orange; mixtures thereof and the like. The photoconductive particles may be present in the charge generation layer in an amount from about 0.5% to about 95% by volume.

Preferably, the photoconductive particles are sensitive to infrared light. More preferably, the photoconductive particles are infrared sensitive phthalocyanine pigments, such and vanadyl phthalocyanine.

It is to be understood that the charge generation layer need not be a binder resin having dispersed photoconductive particles. In embodiments, the charge generation layer can be a homogeneous layer, such as amorphous selenium, selenium alloys such as selenium-tellurium-arsenic alloys and, in fact, any other charge generating photoconductive material. For flexible imaging members, the charge generating material should be selected to withstand a minimum flexing stress required in a flexible imaging member.

Transport layer 15 generally comprises a transparent electrically inactive polycarbonate resinous material having dispersed therein from about 25 to about 75% by weight of the composition of one or more of the diamines within the scope of formula (I):

(I)

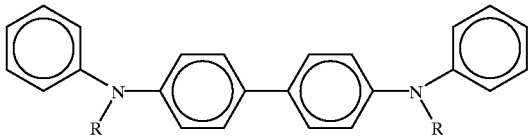

wherein R is

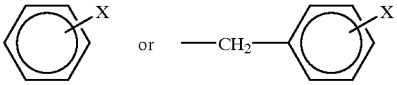

and wherein X is independently selected from the group consisting of an alkyl group having from 1 to about 4 carbon atoms (e.g. methyl, ethyl, propyl, butyl, etc.) and chlorine in the ortho, meta or para position.

A preferred diamine charge transport material is N,N'-diphenyl-N,N'-bis(3-methyl-phenyl)-[1,1'-biphenyl]-4,4'-diamine.

In general, the thickness of transport layer 15 is from about 5 to about 100 microns, but thicknesses outside this range can also be used.

Preferred polycarbonate resins for the transport layer have a molecular weight from about 20,000 to about 120,000, more preferably from about 50,000 to about 120,000. Exemplary electrically inactive resinous materials are poly(4,4'-isopropylidenediphenylene) carbonate and poly(4,4'-cyclohexylidenediphenylene) carbonate. Preferably, the charge transport layer contains from about 40 to about 60% polycarbonate resinous material.

Transport layer 15, as described above, is substantially nonabsorbing to light in the wavelength region employed to generate holes in the photoconductive layer. A preferred range for xerographic utility is from about 4,000 to about 8,000 angstrom units. In addition, the photoconductor should be responsive to all wavelengths from 4,000 to 8,000 angstrom units if panchromatic responses are required. Photoconductor-active material combinations of the instant invention result in the injection and subsequent transport of holes across the physical interface between the photoconductor and the active material.

In order to effectively dissolve the charge transport diamine compound in a polycarbonate matrix, a suitable mutual solvent system may be employed. Methylene chloride, i.e. $CH_2C_2$, is effective in embodiments for this purpose, although other halogen-containing solvents such as chloroform, and 1,2-dichloroethane and the like, and non-halogen-containing organic solvents such as tetrahydrofuran and the like can be employed. Mixtures of these and other solvents may also suitably be employed in embodiments of the invention.

The transport layer may also comprise a residual amount of the above solvent. As used herein, a "residual amount" of a solvent represents from about 0.01 to about 1.0 weight percent of the transport layer. Subjecting the transport layer to a temperature of about 80° C. for about 2 hours will generally reduce the solvent content to about 0.1 weight percent.

Dispersed or dissolved in the transport layer, in order to greatly minimize or eliminate both corona induced image deletion and cleaning blade squeak, is one or more of the diaryl or triaryl methanes within the scope of formula (II):

(II)

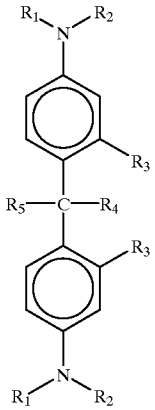

wherein $R_1$ and $R_2$ are independently selected from the group consisting of an alkyl having 1 to 8 carbon atoms, aryl, alkaryl and aralkyl, where said aryl is a phenyl group or a condensed ring group, and where the alkyl group of said alkaryl and aralkyl has 1 to 4 carbon atoms; $R_3$ and $R_4$ are independently selected from the group consisting of hydrogen and $CH_3$; and $R_5$ is selected from the group consisting of an alkyl having 1 to 8 carbon atoms, aryl, alkaryl, aralkyl, and disubstituted aminophenyl group having substituents independently selected from the group consisting of an alkyl having 1 to 8 carbon atoms, aryl, alkaryl and aralkyl, where each said aryl is a phenyl group or a condensed ring group, and each said alkyl group of each said alkaryl and aralkyl has 1 to 4 carbon atoms. In a preferred embodiment, $R_4$ is hydrogen.

Examples of compounds of this class include, but are not limited to, bis(4-N,N'-diethylamino-2-methylphenyl)phenyl methane and bis-[4-N,N'-diethylamino-2-chlorophenyl] phenyl methane. A preferred compound in embodiments of this invention is bis(4-N,N'-diethylamino-2-methylphenyl) phenyl methane.

The compound of formula (II) may be employed in any effective amount that will inhibit or greatly minimize the deleterious effects of UV light on the charge transport diamine compound and/or the squeak. Generally, the compound of formula (II) is present in a weight ratio to the diamine transport compound of formula (I) of no more than 1:1. Preferably, the compound of formula (II) is present in a weight ratio to the diamine transport compound of greater than 0.1:1 and less than 1:1. More preferably, the weight ratio is between greater than 0.1:1 and about 0.5:1. Even more preferably the weight ratio is from about 0.12:1 to about 0.25:1.

Figure 2:
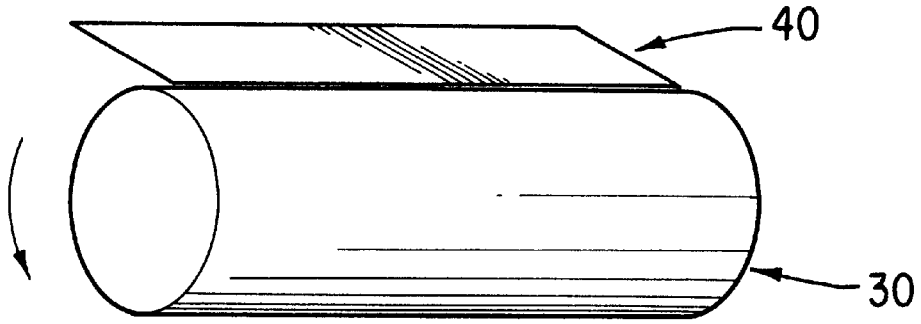
FIG. 2 is an illustration of a drum imaging member and a cleaning blade.
Figure 3:
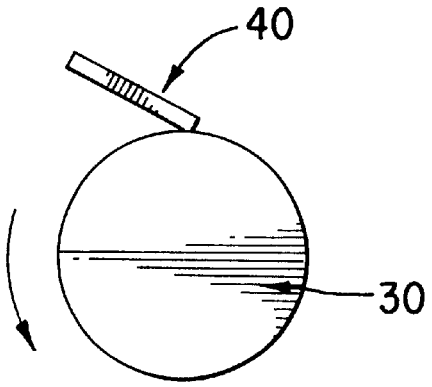
FIG. 3 is a side view of FIG. 2.

The electrophotographic system of the present invention, in embodiments, further comprises a cleaning blade, as demonstrated in FIGS. 2 and 3. Referring to FIGS. 2 and 3, reference character 30 designates a drum imaging member and reference character 40 designates a cleaning blade.

Typical cleaning blades are utilized in the doctor mode, which scrapes residual toner particles from the imaging surface. Typical cleaning blade materials, include, for example, polyurethane, polyesterurethane, and polyetherurethane.

The following examples further specifically define the present invention with respect to preparing the imaging member. The percentages are by weight unless otherwise indicated. The examples are intended to illustrate various comparisons and embodiments of the instant invention. It is understood that the invention is not limited to the materials, conditions, process parameters, etc. recited therein.

COMPARATIVE EXAMPLE I

A charge generation layer is prepared on a 84 mm diameter aluminum drum as follows: 2.4 grams polyvinyl butryal is dissolved in 36.6 gram butylacetate. To this solution are added 1.3 grams of vanadyl phthalocyanine and the solution is then ball milled for about 48 hours. The resulting slurry is diluted with 52.2 grams butylacetate. An approximately 0.5 to 1.0 micron thick layer is applied from a coating of this slurry onto a substrate that has been previously coated with a thin alcohol soluble polyamide. This layer is heated at 105° C. for 10 minutes in a forced air oven.

An approximately 25 micron thick transport layer is formed on top of the charge generation layer as follows:

2.4 grams of poly(4,4'-cyclohexylidenediphenylene) carbonate and 1.6 gram of N,N'-diphenyl-N,N'-bis(3-methylphenyl)-[1,1'-biphenyl]4,4'diamine in about 20 grams of chlorobenzene. A layer of this combination is deposited onto the charge generation layer so that after the removal of solvent at 120° C. for 1.0 hour an approximate 20–25 micron thick layer remains .

When xerographically tested, some evidence of image deletion is noted when the photoreceptor is subjected to the corotron parking deletion test at 80° F./80% RH. The test procedure allows the charge corotron and the photoreceptor main drives to run continuously for an hour. The apparatus was shutdown and allowed to stand for ten minutes. After this period, five test prints were made, and inspected for evidence of parking deletions. Five test prints were again generated an hour later, and again approximately 18 hours later. In addition squeak measurements taken at various exhibited some unacceptable results as shown in Table 1.

TABLE 1

| (° C.) | Running |
|---|---|
| 55 | 1 |
| 50 | 5 |
| 45 | 5 |
| 40 | 5 |
| 35 | 3 |
| 30 | 2 |
| 25 | 2 |

Squeak grades 1-best; 5-worst 1–2 acceptable, 3–5 unacceptable

To examine the squeak produced by the device, the drum imaging member is cleaned using a polyurethane type doctor blade. Although the doctor blade is effective in removing the residual image, an irritating squeak is emitted.

EXAMPLE I

A charge generation layer composed of vanadyl phthalocyanine and polyvinyl butryal is prepared on a drum in the same manner as Comparative Example 1. A homogenous charge transport layer is prepared from a solution of 8.6 grams of poly(4,4'-cyclohexylidenediphenylene) carbonate, 5.2 grams of N,N'-diphenyl-N,N'-bis(3-methylphenyl)-[1,1'-biphenyl]-4,4'-diamine and 0.6 gram of bis(4'-N,N'-diethylamino-2-methylphenyl) phenyl methane in 45.6 grams of chlorobenzene. A homogenous layer of this combination is deposited onto the charge generation layer so that after removal of the chlorobenzene solvent an approximately 20–25 micron thick homogenous layer remains. The device is heated at 120° C. for about 1 hour in vacuum.

When electrically and xerographically tested, there is no increase in dark decay, and no image deletion problems are noted at 80° F./80% RH. The degradation of the diamine containing layer is prevented by the addition of the substituted methane molecule. Further, the squeak measurements at various temperatures are demonstrated in Table 2.

TABLE 2

| SQUEAK TESTING | | | |
|---|---|---|---|
| (° C.) | Startup | Running | Shutdown |
| 55 | 1 | 1 | 1 |
| 50 | 1 | 1 | 1 |
| 45 | 1 | 1 | 2 |
| 40 | 1 | 1 | 1 |
| 35 | 1 | 1 | 1 |
| 30 | 1 | 1 | 1 |
| 25 | 1 | 1 | 1 |

Squeak grades are rated from 1 (best) to 5 (worst), 1–2 being acceptable, 3–5 being unacceptable.

EXAMPLE II

A photoreceptor is prepared similar to the device of Example I except that the homogeneous charge transport layer composition is varied slightly. The homogeneous charge transport layer is coated from a solution of 8.6 grams of poly(4,4'-cyclohexylidenediphenylene) carbonate, 5.5 grams of the diamine and 0.3 gram of the substituted methane compound in 45.6 grams chlorobenzene. After deposition of the homogenous charge transport layer, the device is heated at 120° C. for 1 hour.

When electrically tested, no change in dark decay and no increase in residual potential is observed. The photodischarge of the device containing the diamine and the substituted methane compound in polycarbonate is the same as that of the device containing no substituted methane compound. The presence of the substituted methane compound does not adversely impact the charge transport characteristics of the transport layer. Further, the squeak grades are acceptable, as demonstrated in Table 3.

TABLE 3

| SQUEAK TESTING | | | |
|---|---|---|---|
| (° C.) | Startup | Running | Shutdown |
| 55 | 1 | 4 | 1 |
| 50 | 1 | 1 | 1 |
| 45 | 1 | 1 | 2 |
| 40 | 1 | 1 | 1 |
| 35 | 1 | 1 | 1 |
| 30 | 1 | 1 | 1 |
| 25 | 1 | 1 | 1 |

Squeak grades are rated 1–5: 1–2 being acceptable, 3–5 being unacceptable.

What is claimed is:

1. An imaging member comprising a charge generation layer and a contiguous charge transport layer, said charge transport layer comprising:

(1) a diamine compound of formula (I):

(I)

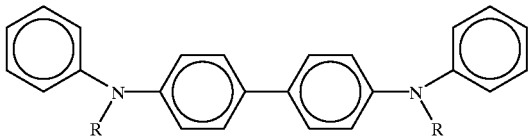

wherein R is

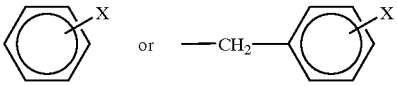

and wherein X is independently selected from the group consisting of alkyl having from 1 to about 4 carbon atoms and chlorine in the ortho, meta or para position; and (2) a compound of formula (II):

(II)

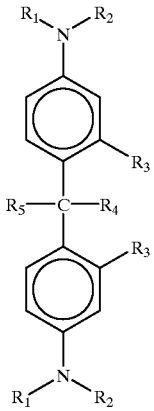

wherein $R_1$ and $R_2$ are independently selected from the group consisting of alkyl having 1 to 8 carbon atoms, aryl, alkaryl and aralkyl, where said aryl is a phenyl group or a condensed ring group, and where the alkyl group of said alkaryl and aralkyl has 1 to 4 carbon atoms;

$R_3$ and $R_4$ are independently selected from the group consisting of hydrogen and $CH_3$; and $R_5$ is selected from the group consisting of alkyl having 1 to 8 carbon atoms, aryl, alkaryl, aralkyl, and disubstituted aminophenyl group having substituents independently selected from the group consisting of alkyl having 1 to 8 carbon atoms, aryl, alkaryl and aralkyl, where each said aryl is a phenyl group or a condensed ring group, and each said alkyl group of each said alkaryl and aralkyl has 1 to 4 carbon atoms;

said transport layer being free of halogen containing organic solvent.

2. The imaging member of claim 1, wherein, in said compound of formula (II), said $R_4$ represents hydrogen.

3. The imaging member of claim 1, wherein the weight ratio of said compound of formula (II) to said diamine compound of formula (I) is at least 0.04:1.

4. The imaging member of claim 1, wherein said methane compound is bis(4-N,N'-diethylamino-2-methylphenyl) phenyl methane.

* * * * *